US011624289B2

(12) United States Patent
Gong et al.

(10) Patent No.: US 11,624,289 B2
(45) Date of Patent: Apr. 11, 2023

(54) BARRIER LAYER AND SURFACE PREPARATION THEREOF

(71) Applicants: Rolls-Royce Corporation, Indianapolis, IN (US); Rolls-Royce High Temperature Composites, Inc., Cypress, CA (US)

(72) Inventors: Stephanie Gong, Indianapolis, IN (US); Scott Nelson, Carmel, IN (US); Sungbo Shim, Irvine, CA (US); Li Li, Carmel, IN (US); Robert Alexander Sean Golden, Noblesville, IN (US)

(73) Assignees: Rolls-Royce Corporation, Indianapolis, IN (US); Rolls-Royce High Temperature Composites, Inc., Cypress, CA (US)

( * ) Notice: Subject to any disclaimer, the term of this patent is extended or adjusted under 35 U.S.C. 154(b) by 66 days.

(21) Appl. No.: 17/302,003

(22) Filed: Apr. 21, 2021

(65) Prior Publication Data

US 2022/0341335 A1 Oct. 27, 2022

(51) Int. Cl.
*F01D 5/28* (2006.01)

(52) U.S. Cl.
CPC ..... *F01D 5/288* (2013.01); *F05D 2230/13* (2013.01); *F05D 2230/314* (2013.01); *F05D 2230/90* (2013.01); *F05D 2250/18* (2013.01); *F05D 2300/2261* (2013.01); *F05D 2300/6033* (2013.01); *F05D 2300/611* (2013.01)

(58) Field of Classification Search
CPC ..... F01D 5/288; F05D 2230/90; C04B 41/53; C04B 41/50; C04B 41/4501; C04B 41/5024; C04B 41/0036; C04B 41/89; C04B 41/52; C04B 41/5096; C04B 41/009; C04B 35/565; C04B 35/80; C04B 14/46; C23C 4/02; C23C 4/18; C23C 4/10; C23C 4/11; C23C 4/12; C23C 4/134;

(Continued)

(56) References Cited

U.S. PATENT DOCUMENTS 4,289,447 A * 9/1981 Sterman ..... F01D 11/125 428/116
5,064,727 A * 11/1991 Naik ..... F01D 11/125 428/937

(Continued)

FOREIGN PATENT DOCUMENTS

EP 3434803 A1 1/2019

OTHER PUBLICATIONS

More et al., "Evaluating Environmental Barrier Coatings on Ceramic Matrix Composites After Engine and Laboratory Exposures", Jan. 2002, 9 pgs.

*Primary Examiner* — Topaz L. Elliott
(74) *Attorney, Agent, or Firm* — Shumaker & Sieffert, P.A.

(57) ABSTRACT

In some examples, the disclosure describes an article and a method of making the same that includes a substrate defining an outer surface, a barrier layer on the outer surface of the substrate, the barrier layer defining a textured surface having a plurality of cells, each cell having a geometry and a depth, and an overlying layer formed on the textured surface of the barrier layer. The barrier layer may be configured to reduce migration of material from the substrate to the overlaying layer to reduce or prevent formation of cristobalite phase thermally grown oxide.

20 Claims, 7 Drawing Sheets

(58) Field of Classification Search
CPC ..... C23C 28/00; C23C 28/04; C23C 28/042; C23C 28/30; C23C 28/345
See application file for complete search history.

(56) References Cited

U.S. PATENT DOCUMENTS 5,419,971 A * 5/1995 Skelly ..... C23C 4/02 428/164
5,496,644 A 3/1996 Lee et al.
5,869,146 A 2/1999 McCluskey et al.
6,254,935 B1 7/2001 Eaton et al.
6,299,988 B1 10/2001 Wang et al.
6,455,167 B1 * 9/2002 Rigney ..... C23C 28/00 428/472
6,517,959 B1 * 2/2003 Beele ..... C23C 8/02 427/419.7
6,787,195 B2 9/2004 Wang et al.
6,964,818 B1 * 11/2005 Darolia ..... F01D 5/288 148/438
7,300,702 B2 11/2007 Li et al.
9,527,109 B2 12/2016 Margolies et al.
9,598,969 B2 * 3/2017 Wada ..... F01D 11/122
9,713,912 B2 7/2017 Lee
10,196,920 B2 * 2/2019 Subramanian ..... C23C 4/04
10,822,998 B2 11/2020 Luthra et al.
10,851,026 B2 12/2020 Li et al.
11,073,029 B2 * 7/2021 Schrüfer ..... F01D 11/125
2004/0151840 A1 8/2004 Wang et al.
2005/0013993 A1 1/2005 Li et al.
2005/0064146 A1 3/2005 Hollis et al.
2007/0141368 A1 * 6/2007 Farmer ..... F01D 5/288 427/456
2010/0080984 A1 4/2010 Lee
2011/0033630 A1 2/2011 Naik et al.
2013/0122259 A1 * 5/2013 Lee ..... C23C 4/02 428/164
2013/0177440 A1 * 7/2013 Zhang ..... C04B 41/009 156/280
2014/0023482 A1 * 1/2014 Wada ..... F01D 11/00 415/110
2014/0199163 A1 7/2014 Lee
2014/0272169 A1 9/2014 Lee
2014/0272310 A1 9/2014 Lazur et al.
2015/0118444 A1 * 4/2015 Lipkin ..... B05D 5/00 427/256
2016/0017749 A1 * 1/2016 Luthra ..... C04B 41/52 428/448
2016/0040551 A1 * 2/2016 Strock ..... F01D 5/288 427/197
2016/0215631 A1 * 7/2016 Wan ..... C04B 41/52
2017/0121232 A1 5/2017 Nelson et al.
2017/0144939 A1 5/2017 Lee
2018/0066527 A1 * 3/2018 Kadau ..... F01D 11/122
2019/0323112 A1 10/2019 Shim et al.
2020/0049018 A1 * 2/2020 Schrüfer ..... C09D 1/00
2020/0116033 A1 * 4/2020 Srinivasan ..... F01D 5/288
2020/0370439 A1 * 11/2020 Nelson ..... B23P 6/007

* cited by examiner

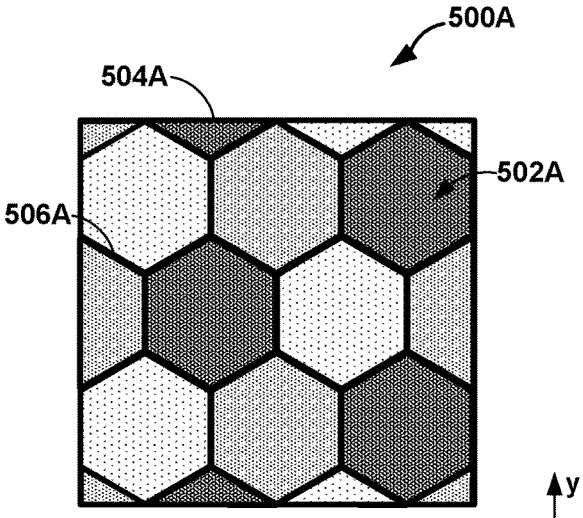
FIG. 5A
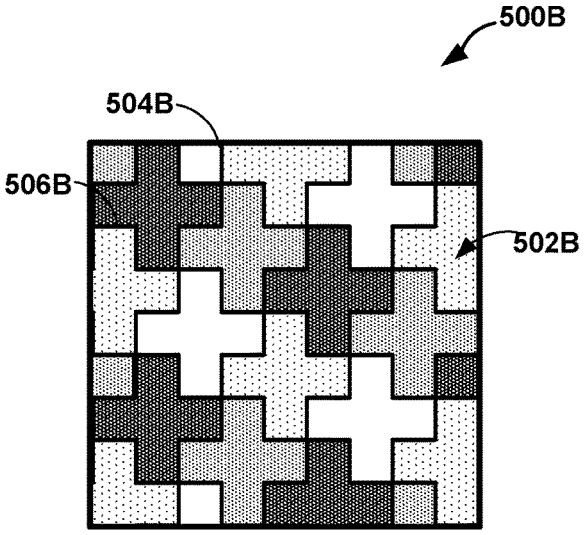
FIG. 5B
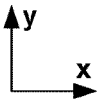
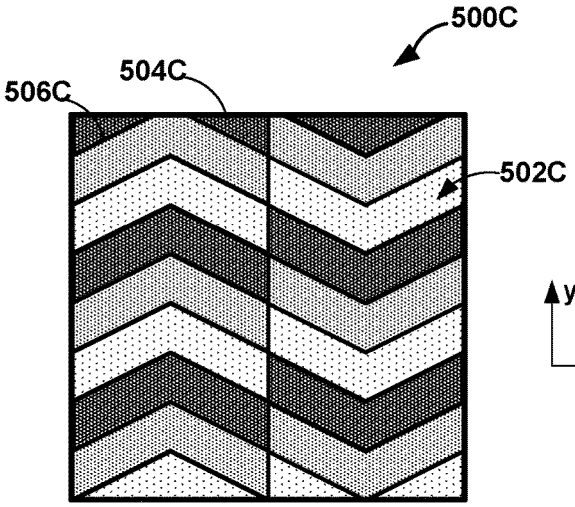
FIG. 5C
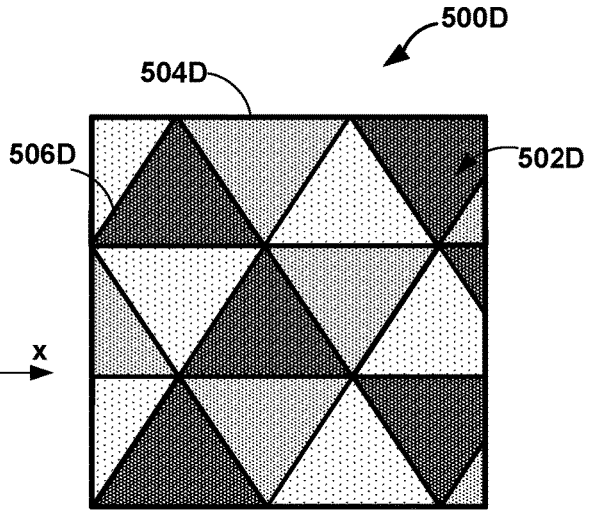
FIG. 5D
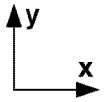

BARRIER LAYER AND SURFACE PREPARATION THEREOF

TECHNICAL FIELD

The present disclosure relates to coating interfaces, and more particularly, but not exclusively, to coating interfaces on composite substrates.

BACKGROUND

Ceramic matrix composite (CMC) materials may be useful in a variety of contexts where mechanical and thermal properties are important. For example, components of high temperature mechanical systems, such as gas turbine engines, may be made from CMCs. CMCs may be resistant to high temperatures, but some CMCs may react with some elements and compounds present in the operating environment of high temperature mechanical systems, such as water vapor. These reactions may damage the CMC and reduce mechanical properties of the CMC, which may reduce the useful life of the component. Thus, in some examples, a CMC component may be coated with various coatings, which may reduce exposure of the CMC component to elements and compounds present in the operating environment of high temperature mechanical systems.

SUMMARY

The disclosure describes articles and techniques for forming articles that include a barrier layer having a textured surface and an overlying layer on the textured surface of the barrier layer. An example article may include a component of a high temperature mechanical system, such as a gas turbine engine airfoil or vane. The component may include a substrate, such as a silicon metal (Si) containing composite substrate, and a coating system that includes the barrier layer having the textured surface and one or more overlaying layers on the textured surface of the barrier layer. In some examples, the barrier layer includes silicon carbide and the overlaying layer includes an environmental barrier coating (EBC). The barrier layer may reduce migration of material from the substrate into the one or more overlying layers to reduce formation of thermally grown oxide (TGO) phases that may damage or otherwise reduce the useable life of the article.

In some examples, the disclosure describes an article including a substrate defining an outer surface; a barrier layer on the outer surface of the substrate, where the barrier layer defines a textured surface having a plurality of cells, each cell having a geometry in a major plane of the barrier layer and a depth; and an overlying layer on the textured surface of the barrier layer.

In some examples, the disclosure describes gas turbine engine component that includes a ceramic composite matrix (CMC) substrate defining an outer surface; a silicon carbide barrier layer on the outer surface of the substrate, where the barrier layer defines a textured surface having a plurality of cells, each cell having a geometry in a major plane of the barrier layer and a depth; a bond coat formed on the textured surface of the barrier layer; and an environmental barrier coating (EBC) formed on bond coat.

In some examples, the disclosure describes a method for forming an article, the method includes forming a barrier layer on an outer surface of a substrate; texturing a surface of the barrier layer to form a textured surface by forming a plurality of cells in the barrier layer, each cell having a geometry in a plane of the barrier layer and a depth; and forming an overlying layer on the textured surface of the barrier layer.

The details of one or more examples are set forth in the accompanying drawings and the description below. Other features, objects, and advantages will be apparent from the description and drawings, and from the claims.

BRIEF DESCRIPTION OF THE FIGURES

FIGS. 5A-5G are conceptual top-views of respective example barrier layers that include respective pluralities of cells arranged in respective macroscopic patterns to define respective textured surfaces of the respective barrier layers.

DETAILED DESCRIPTION

Figure 1:
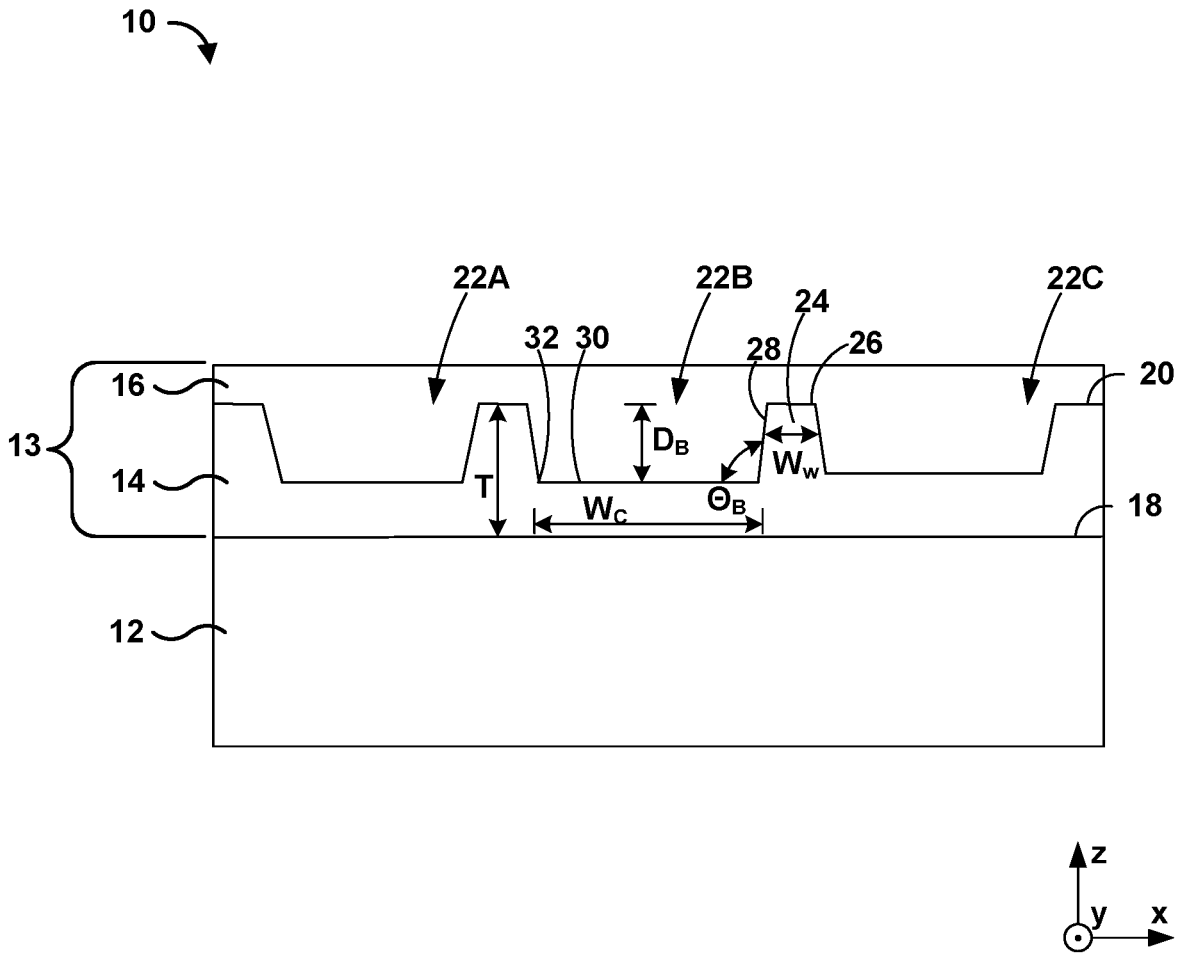
FIG. 1 is a conceptual cross-sectional view of an example article including a substrate, a barrier layer having a textured surface on the substrate, and an overlying layer on the textured surface of the barrier layer.

The disclosure describes articles and techniques for reducing formation and/or crystallization of thermally grown oxide (TGO) in a coating system on a substrate of a composite article. TGO may form on a surface of a metal-containing bond coat or an interface between a metal-containing bond coat and an overlying layer. For example, silicon oxide (e.g., $SiO_2$) TGO and the cracking that results from crystallization of TGO may occur between a bond coat on a substrate and an overlying layer on the bond coat. The formation of crystalline phases, such as the cristobalite phase, may cause the TGO to crack upon thermal cycling. The cracking may reduce the interfacial strength between the bond coat and the overlying layer. Therefore, it is desirable to maintain TGO as an amorphous phase.

The diffusion of impurities such as boron from a substrate into a bond coat or interface between a bond coat and overlying layer may accelerate the formation of crystalline phases in the TGO. A barrier layer, such as, for example, silicon carbide (SiC), may reduce the migration of impurities from the substrate into the bond coat and/or to the interface of the bond coat and an overlying coating. In this way, a barrier layer may maintain TGO as an amorphous phase. Using chemical vapor deposition (CVD) process, a dense and pore free layer of SiC may be deposited onto the substrate. However, due to a smoothness of CVD deposited SiC, it may be difficult to adequate adhesion of a bond coat or other layers overlying the SiC barrier layer. For example, a surface roughness (Ra) of CVD deposited SiC may be within a range from about 0.25 microns to about 5 microns, such as from about 0.5 microns to about 2 microns. Additionally, due to a brittleness of CVD deposited SiC, it may be difficult to modify the SiC surface, e.g., by grit blasting or the like, to create sufficient surface roughness for adequate adhesion of a bond coat or other layers overlying the SiC barrier layer.

Laser ablation or non-ablation laser surface modification of the barrier layer may be used to improve adhesion of the bond coat, overlying layer, or both. For example, laser ablation may selectively remove material from the barrier layer in a controlled manner by evaporation, producing a texture that improves coating adhesion. The texture may include any suitable geometry, pattern, or depth. A bond coat or overlying layer may be applied to the textured surface of the barrier layer with improved adhesion relative to a non-textured barrier layer. Optionally, a second barrier layer may be applied to the textured surface of the first barrier layer. Additionally, or alternatively, a bond coat or overlying layer applied to the textured barrier layer may be textured to further improve adhesion of other overlying layers of the coating system.

In some examples, the textured surface may be formed in the barrier layer using laser ablation or non-ablation surface modification (together reference to as a laser removal process). The laser removal process may reduce the chance of the barrier layer or the substrate cracking during processing (e.g., compared to using mechanical machining). The laser removal process also may result in a cleaner outer surface compared to other processing techniques (e.g., micromachining or grit blasting), which may improve the adhesion between layers overlying the barrier layer. For example, the cleaner outer surface may include few impurities or defects, such as oxides, nitrides, or residues that may be caused by other processing techniques. Additionally, or alternatively, the laser removal process may reduce the amount of heat applied to the outer surface of the barrier layer and/or the substrate compared to mechanical machining, thereby reducing the likelihood of the underlying reinforcement material of the substrate becoming oxidized and/or having its mechanical properties compromised. The laser removal process also may have the benefit of being highly localized and may be applied in specific locations as needed and not in sensitive areas, which may reduce material degradation.

FIG. 1 is a conceptual cross-sectional view of an example article 10 including a substrate 12 and a coating system 13. Coating system 13 may include a barrier layer 14 and a overlying layer 16 on barrier layer 14. In some examples, overlying layer 16 may include a second barrier layer or a bond coat. In some examples, coating system 13 may include additional coating layers (e.g., overlying layer 16 may include a plurality of layers). For example, overlying layer 16 may include one or more of a bond coat, a thermal barrier coating (TBC), an environmental barrier coating (EBC), an abradable coating, a calcia-magnesia-aluminosilicate (CMAS)-resistant coating, combinations thereof, or the like.

Substrate 12 defines an outer surface 18 extending in the x-y plane. Barrier layer 14 is on outer surface 18. In some examples, outer surface 18 may be modified to improve adhesion of barrier layer 14. For example, outer surface 18 may be grit blasted or textured by laser process, such as described in U.S. patent application Ser. No. 15/273,095, filed on Sep. 22, 2016, entitled "Coating Interface", the entire contents of which is incorporated herein by reference.

Barrier layer 14 defines textured surface 20. Textured surface 20 includes a plurality of cells 22A, 22B, and 22C (collectively, "cells 22"). Cells 22 may be configured to improve the adhesion between barrier layer 14 and overlying coat 16. For example, cells 22 may increase the surface area of textured surface 20 and/or provide mechanical interlocks to improve the adhesion of overlying layer 16 to barrier layer 14 compared to a barrier layer without a textured surface. In some examples, a surface roughness (Ra) of texture surface 20 may be within a range from about 3 microns to about 75 microns, such as about 5 microns to about 25 microns.

Each cell of cells 22 defines a geometry in the x-y plane (e.g., a major plane of barrier layer 14), and a depth extending in the z-direction (e.g., depth $D_B$ substantially normal to outer surface 18). In some examples, the depth of each cell of cells 22 may be substantially similar, e.g., the same within tolerances of laser removal processes. In other examples, the depth of a respective cell of cells 22 may be different than the depth of at least one adjacent cell of cells 22 (e.g., each adjacent cell of cells 22). For example, cell 22B has a depth $D_B$, which may be greater than a depth of adjacent cells 22A and 22C. In some examples, the variation in depth of cells 22 may reduce migration of impurities between adjacent cells 22, reduce the propagation of cristobalite phase TOG between adjacent cells 22, or both.

In some examples, textured surface 20 of barrier layer 14 may define a plurality of walls separating adjacent cells, e.g., wall 24 separating cell 22B and 22C. Wall 24 includes an apex 26 and defines a cell wall 28. In some examples, adjacent cells of cells 22 may be separated by a selected distance (e.g., the width of wall 24). For example, a width $W_W$ of wall 24 may be within a range from about 1 microns to about 500 microns, such as from about 5 microns to about 250 microns. In some examples, textured surface 20 may not include cell walls 24, such that each cell of cells 22 is defined by the difference in depth of adjacent cells 22.

Cell wall 28 extends from cell base 30 to apex 26. Apex 26 may include a plateau that is substantially parallel to outer surface 18 of substrate 12 (e.g., as illustrated in FIG. 1) or any suitable rectilinear surface, curvilinear surface, or point. Cell wall 28 may extend from cell base 30 at any suitable angle. In some examples, cell wall 28 may define a right angle, such as, for example, an angle that is about 90-degrees relative to a plane defined by outer surface 18 of substrate 20 (e.g., relative to the x-y plane of FIG. 1). Using a right angle may facilitate manufacturing by enabling cells 22 to be formed while only requiring a material removal device (e.g., laser) to be kept perpendicular to the surface of article 10. In some examples, cell wall 28 may define an obtuse angle, such as, for example, an angle within a range from about 90-degrees to about 110-degrees. An obtuse angle may facilitate application of overlying layer 16 by, for example, thermal spraying, because edges and/or corners of a respective cell, e.g., edge 32 of cell 22B, are not shadowed from the spray head. In some examples, cell wall 28 may define an acute angle, such as, for example, an angle within a range from about 70-degrees to about 90-degrees. An acute angle may enhance bonding of overlying layer 16 to textured surface 20 because undercuts defined by cell wall 28 define a mechanical interlock of overlying layer 16 and underlying barrier layer 14.

Barrier layer 14 defines a thickness T. For example, thickness T may include a distance from outer surface 18 of substrate 12 to apex 26 of wall 24 defined by barrier layer 14. The thickness T of barrier layer 14 may be selected provide chemical and/or mechanical properties to reduce migration of impurities, e.g., boron, from substrate 12 to overlying layer 16 to reduce formation of cristobalite phase TGO. In some examples, thickness T may be within a range from about 1 microns to about 500 microns, such as about 5 microns to about 250 microns or about 5 microns to about 100 microns. In some examples, each cell of cells 22 may define depth (e.g., depth $D_B$) within a range from about 1 micron to about 250 micron, such as within a range from about 1 micron to about 75 micron. In some examples, a difference between the thickness T of barrier layer 14 and the depth of cells 22 may be selected to be greater than about 3 microns.

The geometry of each cell of cells 22 may be substantially similar or cells 22 may include two or more dissimilar geometries. The shape and size of each cell of cells 22 may be selected to reduce migration of impurities from substrate 12 between adjacent cells 22, provide a selected adhesion between barrier layer 14 and overlying layer 16, or both. In some examples, the geometry of each respective cell of cells 22 may include a width of the respective cell. For example, a width of the widest portion of a respective cell of cells 22 (e.g., the width) may be within a range between about 1 microns and about 500 microns, such as between about 5 microns and about 250 microns. In some examples, the geometry of each cell of cells 22 may include at least one of a polygon, a triangle, a parallelogram, a hexagon, a cross, a chevron, a circle, concentric circles, parallel trenches, or other geometric shapes. In some examples, the geometry of each cell of cells 22 may define irregular shapes, such as fractal patterns or pseudo-random patterns. For example, a laser may be used to generate a simulated grit blasted surface by randomly striking the surface with low powered laser, affecting a shallow layer of material while still providing the surface roughness required for the coating adherence.

In some examples, the geometry of each cell of cells 22 may define shapes based on a geometry of article 10. For example, in examples in which article 10 includes a gas turbine engine blade, cells 22 at a leading edge of the blade may include a first geometry and cells 22 at a trailing edge of the blade may include a second geometry.

Article 10 may include any applicable structure that may benefit from the reduced formation of cristobalite phase TGO or cracking due to TGO crystallization, such as cracks extending between layers of coating system 13 on article 10. In some examples, article 10 may be a component of a high temperature mechanical system. For example, article 10 may be a gas turbine engine component configured to operate in high temperature environments, e.g., operating at temperatures of 1900° F. to 2100° F. or greater (1038° C. to 1149° C. or greater). In some examples, article 10 may be a component of a gas turbine engine that is exposed to hot gases, including, for example, a seal segment, a blade track, an airfoil, a blade, a vane, a combustion chamber liner, or the like.

In examples in which article 10 includes a component of a high temperature mechanical system, the geometry of a respective cell of cells 22 may be based on a predicted stress at the respective cell during operation of the high temperature mechanical system. For example, a first portion of the component of the high temperature mechanical system may experience a greater thermal stress and/or mechanical stress during operation of the mechanical system relative to a second portion of the component. As one example, a leading edge of a gas turbine engine blade may experience greater thermal stress and mechanical stress during operation of a gas turbine engine compared to a trailing edge of the gas turbine engine blade. The first portion of the component may include a first plurality of cells having a first geometry, and the second portion of the component may include a second plurality of cells having a second geometry. In this way, the geometry of the plurality of cells may be selected to withstand selected thermal and/or mechanical stresses.

Substrate 12 of article 10 may be formed from various materials including, for example, a superalloy, a fiber reinforced composite, a ceramic matrix composite (CMC), a metal matrix composite, a hybrid material, combinations thereof, or the like. In some examples, substrate 12 may be a ceramic or CMC substrate. The ceramic or CMC material may include, for example, a silicon-containing ceramic, such as silica ($SiO_2$), silicon carbide (SiC), silicon nitride ($Si_3N_4$), alumina ($Al_2O_3$), aluminosilicate, or the like. In some examples, the ceramic may be substantially homogeneous and may include substantially a single phase of material. In other examples, substrate 12 may include a matrix material and reinforcement material. Suitable matrix materials may include, for example, carbon, silicon carbide (SiC), silicon carbide aluminum boron silicide, silicon nitride ($Si_3N_4$), alumina ($Al_2O_3$), aluminosilicate, silica ($SiO_2$), or the like. In some examples, the matrix material of the CMC substrate may include carbon, boron carbide, boron nitride, or resin (epoxy/polyimide). The matrix material may be combined with any suitable reinforcement materials including, for example, discontinuous whiskers, platelets, or particulates composed of SiC, $Si_3N_4$, $Al_2O_3$, aluminosilicate, $SiO_2$, or the like. In some examples the reinforcement material may include continuous monofilament or multifilament fibers that include fibers of SiC. The reinforcement fibers may be woven or non-woven. In other examples, substrate 12 may include a metal alloy that includes silicon, such as a molybdenum-silicon alloy (e.g., $MoSi_2$) or a niobium-silicon alloy (e.g., $NbSi_2$).

Substrate 12 may be produced using any suitable means. For example, substrate 12 may be produced from a porous preform including reinforcement fibers. The porous preformed may be impregnated with a matrix material using e.g., resin transfer molding (RTM), chemical vapor infiltration (CVI), chemical vapor deposition (CVD), slurry infiltration, melt infiltration, or the like and/or heat treated to produce substrate 12. Barrier layer 14 may include any useful material to reduce migration of one or more materials, e.g., impurities such as boron, from substrate 12 into overlying layer 16. For example, barrier layer 14 may be formulated to exhibit desired chemical or physical barrier between substrate 12 and overlying layer 16. In some examples, barrier layer 14 may include materials configured to form a dense (e.g., denser relative to overlying layer 16) and substantially pore free layer. For example, barrier layer 14 may include silicon metal, silicon carbide, or the like, alone, or mixed with at least one other constituent. The at least one other constituent may include, for example, at least one of a transition metal carbide, a transition metal boride, or a transition metal nitride. Representative transition metals include, for example, Cr, Mo, Nb, W, Ti, Ta, Hf, or Zr. In some examples, barrier layer 14 may be applied by techniques such as spraying (e.g., thermal or plasma spray), pressure vapor deposition (PVD), chemical vapor deposition (CVD), directed vapor deposition (DVD), dipping, electroplating, chemical vapor infiltration (CVI), or the like.

Overlying layer 16 may include one or more of a bond coat, a thermal barrier coating (TBC), an environmental barrier coating (EBC), an abradable coating, a calcia-magnesia-aluminosilicate (CMAS)-resistant coating, a wear resistance coating (e.g., thermally sprayed SiC), combinations thereof, or the like, which are further discuss below in reference to FIGS. 2 and 3. In some examples, overlying layer 16 may perform two or more of functions (e.g., act as an EBC and abradable layer). Overlying layer 16 may be applied to at least partially fill cells 22. In some examples, overlying layer 16 may be applied by techniques such as spraying (e.g., thermal or plasma spray), pressure vapor deposition (PVD), chemical vapor deposition (CVD), directed vapor deposition (DVD), dipping, electroplating, chemical vapor infiltration (CVI), or the like. In some examples, the composition of overlying layer 16 may be selected based on coefficients of thermal expansion, chemical compatibility, thickness, operating temperatures, oxidation resistance, emissivity, reflectivity, and longevity. Overlying layer 16 may be applied on selected portions and only partially cover substrate 12 and/or barrier layer 14, or may cover substantially all of substrate 12 and/or barrier layer 14.

Figure 2:
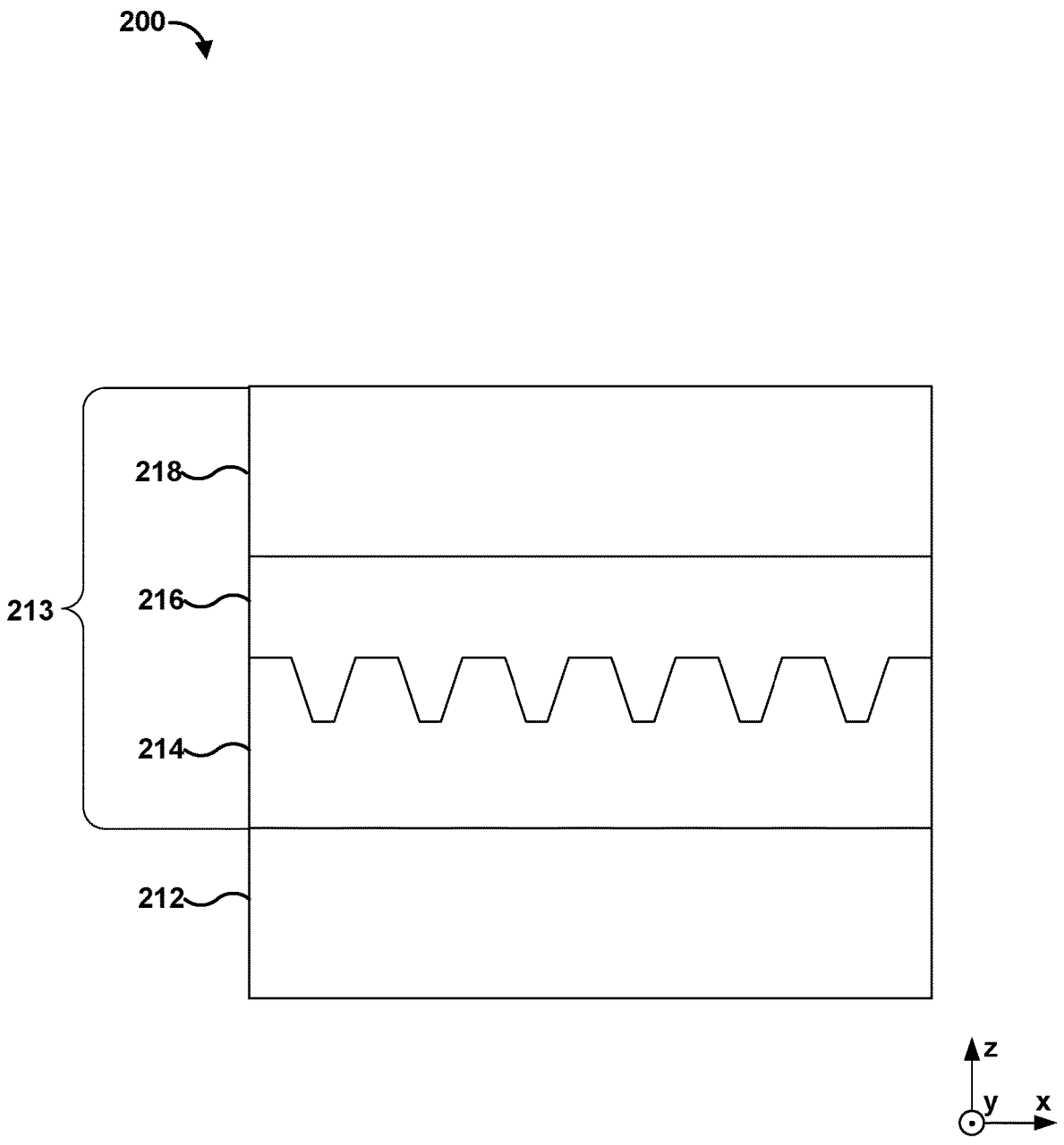
FIG. 2 a conceptual cross-sectional view of an example article including a substrate, a barrier layer having a textured surface on the substrate, bond coat on the textured surface of the barrier layer, and an overlying layer on the bond coat.
Figure 3:
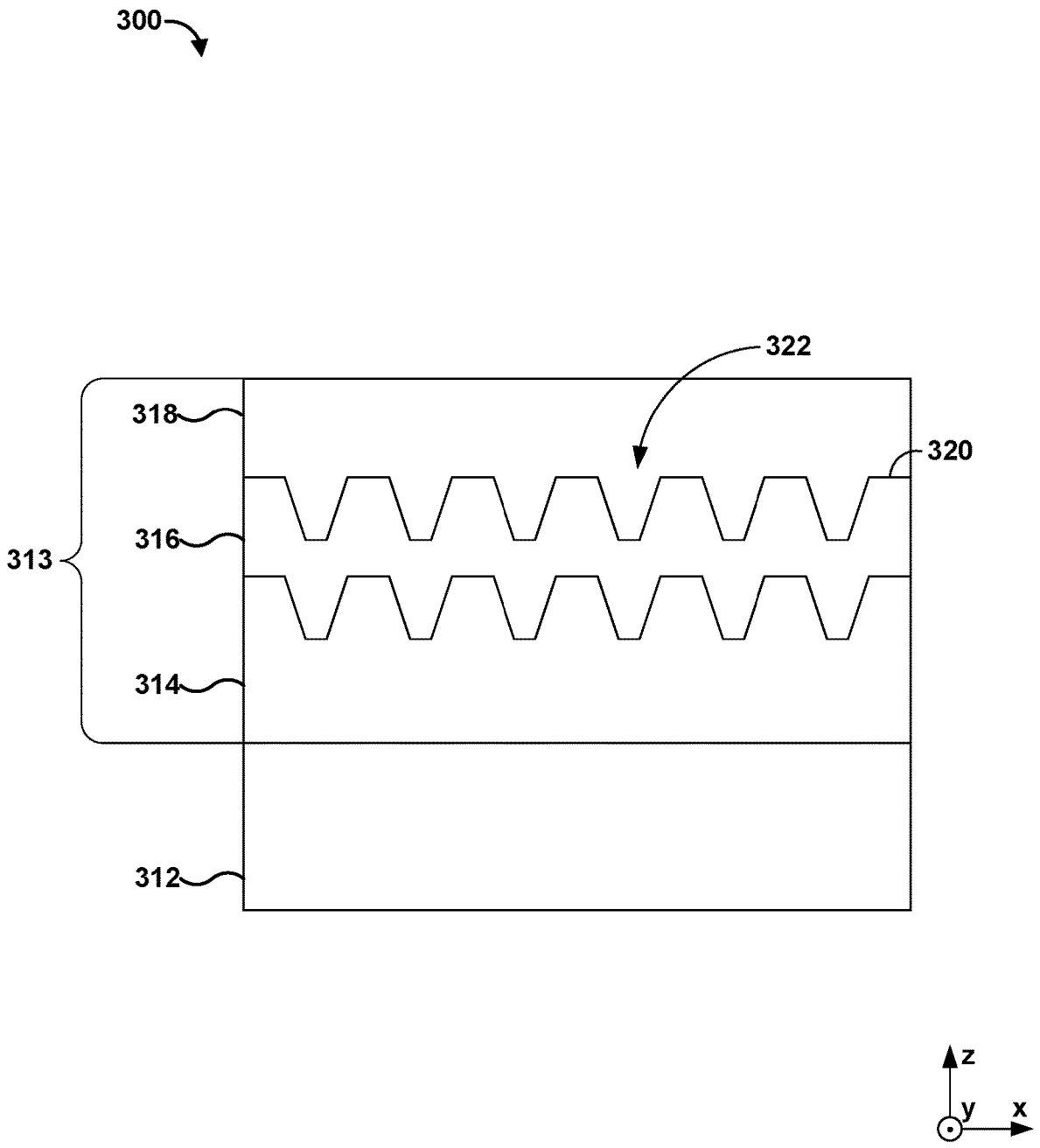
FIG. 3 a conceptual cross-sectional view of an example article including a substrate, a barrier layer having a textured surface on the substrate, bond coat having a textured surface on the textured surface of the barrier layer, and an overlying layer on the textured surface of the bond coat.

FIG. 2 is a conceptual diagram illustrating a cross-sectional view of an example article 200 including a substrate 212 and a coating system 213. Coating system 213 includes a barrier layer 214, a bond coat 216 on barrier layer 214, and an overlying layer 218 on bond coat 216. Substrate 212 and barrier layer 214 may be the same as, or substantially similar to, substrate 12 and barrier layer 14, respectively, as discussed above in reference to FIG. 1, except for the differences described herein.

Bond coat 216 may include any useful material to improve adhesion between barrier layer 214 and overlying layer 218. For example, bond coat 216 may be formulated to exhibit desired chemical or physical attraction between barrier layer 214 and overlying layers 218. In some examples, bond coat 216 may include silicon metal, silicon carbide, metal oxide containing ceramics, or combinations thereof; alone, or mixed with at least one other constituent. The at least one other constituent may include, for example, at least one of a transition metal carbide, a transition metal boride, or a transition metal nitride. Representative transition metals include, for example, Cr, Mo, Nb, W, Ti, Ta, Hf, or Zr. In some examples, bond coat 216 may additionally or alternatively include mullite (e.g., aluminum silicate, $Al_6Si_2O_{13}$), hafnium silicate ($HfSiO_4$), a rare-earth silicate (e.g., $RE_2Si_2O_7$, where RE is a rare earth element), barium strontium aluminosilicate (BSAS), zirconium silicate ($ZrSiO_4$), zirconium titanate ($ZrTiO_4$), hafnium titanium oxide ($HfTiO_4$), silica, a silicide, or the like, alone, or in any combination (including in combination with one or more of silicon metal, a transition metal carbide, a transition metal boride, a transition metal nitride, alumina, silica, or combinations thereof). The rare earth element in the at least one rare earth oxide, the at least one rare earth monosilicate, or the at least one rare earth disilicate may include at least one of Lu (lutetium), Yb (ytterbium), Tm (thulium), Er (erbium), Ho (holmium), Dy (dysprosium), Tb (terbium), Gd (gadolinium), Eu (europium), Sm (samarium), Pm (promethium), Nd (neodymium), Pr (praseodymium), Ce (cerium), La (lanthanum), Y (yttrium), or Sc (scandium). In some examples, the bond coat may be applied by techniques such as spraying (e.g., thermal or plasma spray), pressure vapor deposition (PVD), chemical vapor deposition (CVD), directed vapor deposition (DVD), dipping, electroplating, chemical vapor infiltration (CVI), or the like.

Overlying layer 218 may include one or more of a second bond coat, a thermal barrier coating (TBC), an environmental barrier coating (EBC), an abradable coating, a calcia-magnesia-aluminosilicate (CMAS)-resistant coating, combinations thereof, or the like.

In examples in which overlying layer 218 includes an EBC, the EBC may include materials that are resistant to oxidation or water vapor attack, and/or provide at least one of water vapor stability, chemical stability and environmental durability to substrate 212. In some examples, the EBC may be used to protect substrate 212 against oxidation and/or corrosive attacks at high operating temperatures. For example, EBCs may be applied to protect the ceramic composites such as SiC based CMCs. An EBC coating may include at least one of a rare earth oxide, a rare earth silicate, an aluminosilicate, or an alkaline earth aluminosilicate. For example, an EBC coating may include mullite, barium strontium aluminosilicate (BSAS), barium aluminosilicate (BAS), strontium aluminosilicate (SAS), at least one rare earth oxide, at least one rare earth monosilicate ($RE_2SiO_5$, where RE is a rare earth element), at least one rare earth disilicate ($RE_2Si_2O_7$, where RE is a rare earth element), or combinations thereof. The rare earth element in the at least one rare earth oxide, the at least one rare earth monosilicate, or the at least one rare earth disilicate may include at least one of Lu (lutetium), Yb (ytterbium), Tm (thulium), Er (erbium), Ho (holmium), Dy (dysprosium), Tb (terbium), Gd (gadolinium), Eu (europium), Sm (samarium), Pm (promethium), Nd (neodymium), Pr (praseodymium), Ce (cerium), La (lanthanum), Y (yttrium), or Sc (scandium). In some examples, the at least one rare earth oxide includes an oxide of at least one of Yb, Y, Gd, or Er.

In some examples, an EBC coating may include at least one rare earth oxide and alumina, at least one rare earth oxide and silica, or at least one rare earth oxide, silica, and alumina. In some examples, an EBC coating may include an additive in addition to the primary constituents of the EBC coating. For example, an EBC coating may include at least one of $TiO_2$, $Ta_2O_5$, $HfSiO_4$, an alkali metal oxide, or an alkali earth metal oxide. The additive may be added to the EBC coating to modify one or more desired properties of the EBC coating. For example, the additive components may increase or decrease the reaction rate of the EBC coating with CMAS, may modify the viscosity of the reaction product from the reaction of CMAS and the EBC coating, may increase adhesion of the EBC coating to substrate 212, may increase or decrease the chemical stability of the EBC coating, or the like.

In some examples, the EBC coating may be substantially free (e.g., free or nearly free) of hafnia and/or zirconia. Zirconia and hafnia may be susceptible to chemical attack by CMAS, so an EBC coating substantially free of hafnia and/or zirconia may be more resistant to CMAS attack than an EBC coating that includes zirconia and/or hafnia.

In some examples, the EBC coating may have a dense microstructure, a columnar microstructure, or a combination of dense and columnar microstructures. A dense microstructure may be more effective in preventing the infiltration of CMAS and other environmental contaminants, while a columnar microstructure may be more strain tolerant during thermal cycling. A combination of dense and columnar microstructures may be more effective in preventing the infiltration of CMAS or other environmental contaminants than a fully columnar microstructure while being more strain tolerant during thermal cycling than a fully dense microstructure. In some examples, an EBC coating with a dense microstructure may have a porosity of less than about 20 volume percent (vol. %), such as less than about 15 vol. %, less than 10 vol. %, or less than about 5 vol. %, where porosity is measured as a percentage of pore volume divided by total volume of the EBC coating.

In some examples, overlying layer 218 may include a thermal barrier coating (TBC). The TBC may include at least one of a variety of materials having a relatively low thermal conductivity and may be formed as a porous or a columnar structure in order to further reduce thermal conductivity of the TBC and provide thermal insulation to substrate 212. In some examples, the TBC may include materials such as ceramic, metal, glass, pre-ceramic polymer, or the like. In some examples, the TBC may include silicon carbide, silicon nitride, boron carbide, aluminum oxide, cordierite, molybdenum disilicide, titanium carbide, stabilized zirconia, stabilized hafnia, or the like.

In some examples, overlying layer 218 may include an abradable layer. The abradable layer may include any of the EBC or TBC compositions described herein. The abradable layer may be porous. Porosity of the abradable layer may reduce a thermal conductivity of the abradable layer and/or may affect the abradability of the abradable layer. In some examples, the abradable layer includes porosity between about 10 vol. % and about 50 vol. %. In other examples, the abradable layer includes porosity between about 15 vol. % and about 35 vol. %, or about 20 vol. %. Porosity of the abradable layer is defined herein as a volume of pores or voids in the abradable layer divided by a total volume of the abradable layer, including both the volume of material in the abradable layer and the volume of pores or voids in the abradable layer.

The abradable layer may be formed using, for example, a thermal spraying technique, such as, for example, plasma spraying. Porosity of the abradable layer may be controlled by the use of coating material additives and/or processing techniques to create the desired porosity. In some examples, substantially closed pores may be desired. For example, a coating material additive that melts or burns at the use temperatures of the component (e.g., a blade track) may be incorporated into the coating material that forms the abradable layer. The coating material additive may include, for example, graphite, hexagonal boron nitride, or a polymer such as a polyester, and may be incorporated into the coating material prior to deposition of the coating material over textured surface 20 to form the abradable layer. The coating material additive then may be melted or burned off in a subsequent heat treatment, or during operation of the gas turbine engine, to form pores in the abradable layer. The post-deposition heat-treatment may be performed at up to about 1500° C.

The porosity of the abradable layer can also be created and/or controlled by plasma spraying the coating material using a co-spray process technique in which the coating material and coating material additive are fed into the plasma stream with two radial powder feed injection ports. The feed pressures and flow rates of the coating material and coating material additive may be adjusted to inject the material on the outer edge of the plasma plume using direct 90-degree angle injection. This may permit the coating material particles to soften but not completely melt and the coating material additive to not burn off but rather soften sufficiently for adherence in the abradable layer.

In some examples, bond coat 216 also may include a textured surface formed by laser ablation or non-laser laser surface modification. FIG. 3 is a conceptual diagram illustrating a cross-sectional view of an example article 300 including a substrate 312 and a coating system 313. Coating system 313 includes a barrier layer 314, a bond coat 316 on barrier layer 314, and an overlying layer 318 on bond coat 316. Substrate 312 and coating system 313 may be the same as, or substantially similar to, substrates 12 and/or 212 and coating systems 13 and/or 213, respectively, discussed above in reference to FIGS. 1 and 2, except for the differences described herein.

Bond coat 316 defines a textured surface 320. Textured surface 320 includes a plurality of cells 322 that may be configured to improve the adhesion between bond coat 316 and overlying coat 318. The plurality of cells 322 may be the same as, or substantially similar to cells 22, discussed above in reference to FIG. 1. For example, laser ablation, non-ablation laser surface modification, or other surface modification techniques may be used to form cells 322. Each cell of the plurality of cells 322 defines a geometry in the x-y plane and a depth extending in the z-direction. In some examples, the depth of each cell of cells 22 may be substantially similar or may be different than the depth of at least one adjacent cell. The plurality of cells 322 may increase the surface area of textured surface 320 and/or provide mechanical interlocks to improve the adhesion of overlying layer 318 to bond coat 316 compared to a bond coat without a textured surface.

Figure 4:
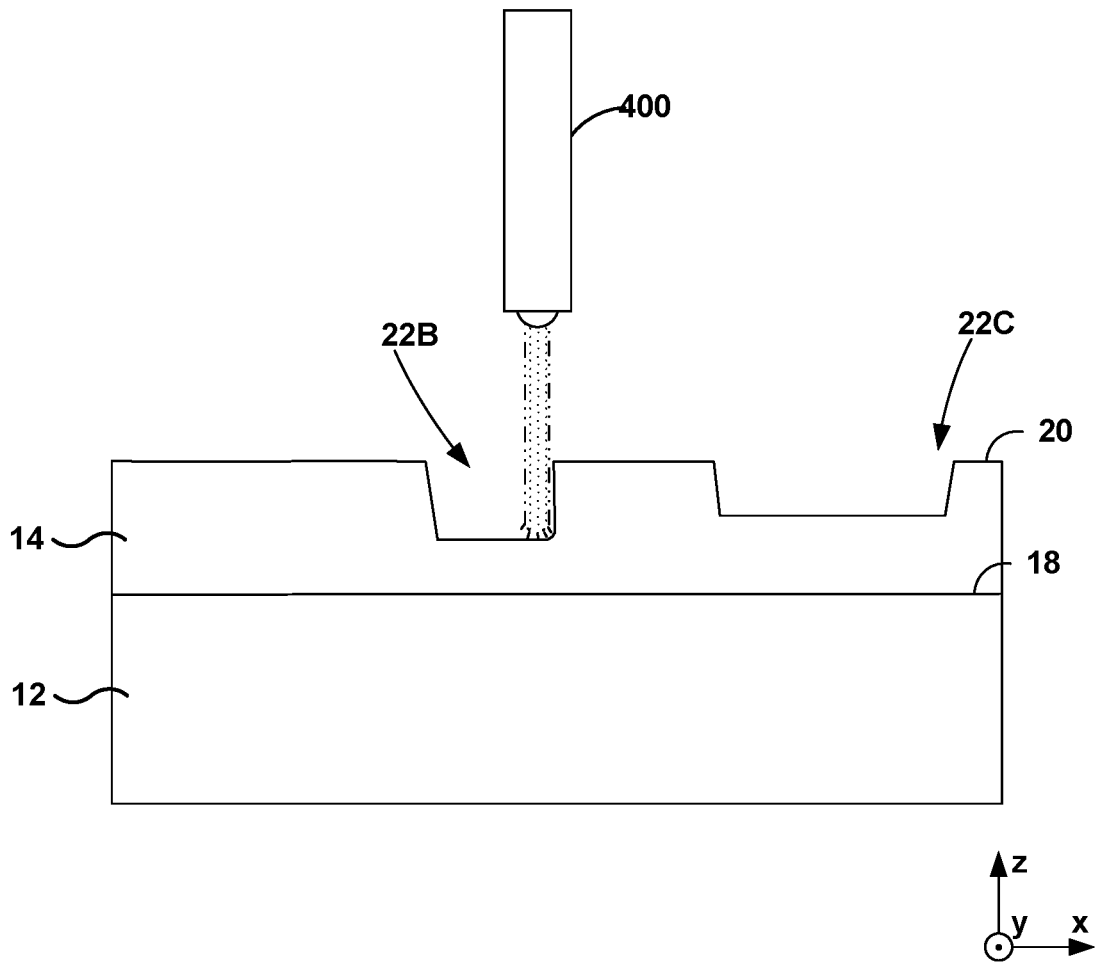
FIG. 4 is a schematic diagram illustrating an article including a barrier layer having a textured surface including a plurality of cells formed by directing a laser at the barrier layer.
Figure 5E:
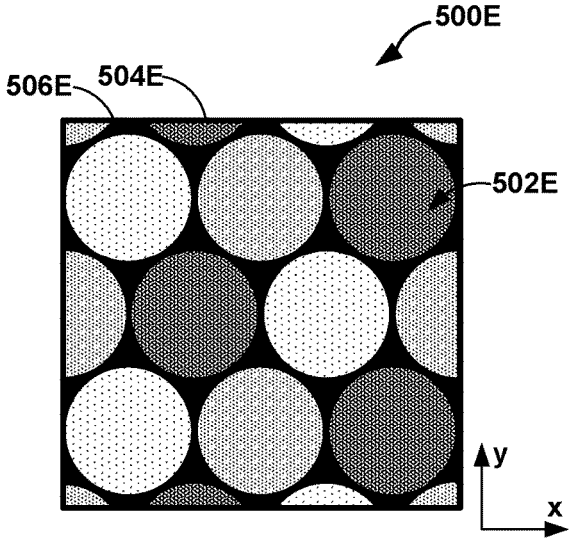
Figure 5F:
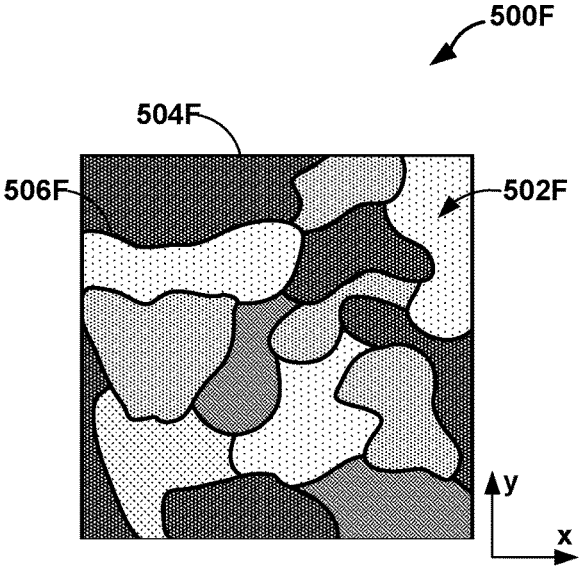
Figure 5G:
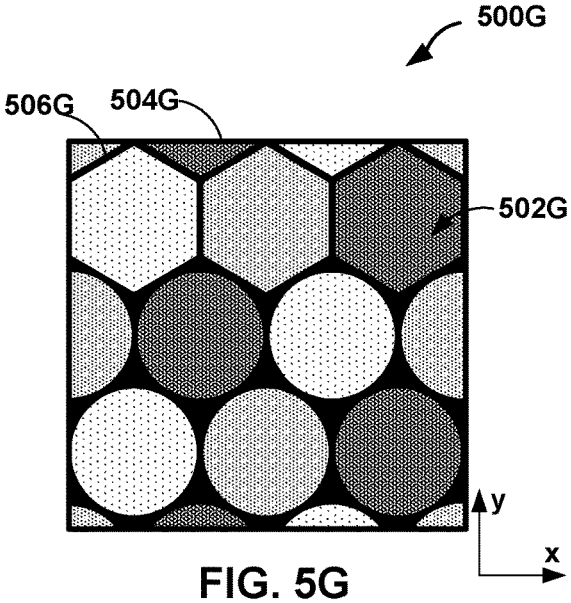

The above describe textured surfaces may be formed using any suitable technique, such as laser ablation or non-ablation laser surface modification. FIG. 4 is a schematic diagram illustrating article 10, described above in reference to FIG. 1, including barrier layer 14 having textured surface 20 including cells 22 formed by directing a laser 400 at barrier layer 14. Laser 400 may be configured to remove portions of material from barrier layer 14 (e.g., textured surface 20) via vaporization or melting the coating material to create cells 22. As laser 400 is drawn over textured surface 20 in the x-y plane to progressively form cells 22, such as cell 22B. During the laser removal process, portions of the removed coating material are expelled from textured surface 20. As the laser removal process continues, subsequent cells 22 are formed on barrier layer 14 to define textured surface 20.

The laser removal process may be performed using any suitable laser 400. In some examples, laser 400 may be operated using a plurality of operating parameters including a beam frequency, a beam power, a defocus value, and a travel speed. The operating parameters of laser 400 may be configured to form plurality of cells 22 that define the selected geometry, selected cell depth (e.g., $D_B$ of cell 22B), and cell width ($W_C$). Additionally, or alternatively, the operating parameters of laser 400 may be configured to reduce or prevent damage to substrate 12, for example, by heating substrate 12 to a temperature that would cause oxidation of one or more materials of substrate 12 In some examples, the operating parameters of laser 400 may be configured to have a beam frequency of less than about 200 Hz, a beam power of about 15 W to about 25 W, a defocus value of about −60 to about 50, and a cutting speed (e.g., the speed in which laser 400 moves across in the x-y plane of substrate surface) of about 10 mm/s to about 200 mm/s.

In some examples, compared to mechanical machining, the laser removal process may significantly reduce the chance of substrate 12 and/or barrier layer 14 becoming cracked during the formation of plurality of cells 22 by reducing the mechanical force applied to substrate 12 and/or barrier layer 14 during processing. Additionally, or alternatively, in some examples, due to the relatively small amount of material removed by ablation laser 400, the amount of heat applied and/or generated in substrate 12 and/or barrier layer 14 may remain relatively low during the formation of plurality of cells 22 compared to other machining techniques. By reducing the heat applied and/or generated on substrate 12 and/or barrier layer 14 during the laser removal process, the chance of the material of substrate 12 (e.g. fibers) and/or barrier layer 14 becoming oxidized prior to the application of overlying layer 16 may be significantly reduced compared to other processing techniques.

In some examples, laser 400 may be configured to form plurality of cells 22 on barrier layer 14 even when outer surface 18 of substrate 12 is non-planar. For example, in some examples the underlying structure of substrate 12 (e.g., the reinforcement fibers) may cause textured surface 20 of barrier layer 14 (e.g., prior to laser ablation) to be uneven or non-planar (e.g., mimicking the pattern of the reinforcement fibers). In such examples, laser 400 may be configured to adjust the incident angle between the laser beam and textured surface 20 to produce cells 22.

Each cell of cells 22 may be formed in barrier layer 14 such that cells 22 progress across the substrate surface (e.g., progress in the x-y plane of FIG. 2) to form a macroscopic pattern. The macroscopic pattern defined by the plurality of cells 22 may be formed in any useful arrangement. For example, FIGS. 5A-5G show conceptual top-views of example barrier layers 500A, 500B, 500C, 500D, 500E, 500F, and 500G (collectively, "barrier layers 500") that include plurality of cells 502A, 502B, 502C, 502D, 502E, 502F, and 502G (collectively, "cells 502") arranged in respective macroscopic patterns to define textured surfaces 504A, 504B, 504C, 504D, 504E, 504F, and 504G (collectively, "textured surfaces 504") of the respective barrier layers 500 (e.g., cells 502 progressing in the x-y plane). As shown in FIGS. 5A-5G, in some examples, cells 502 may define a substantially rectilinear pattern (e.g., hexagon wells 502A of FIG. 5A, crosses 502B of FIG. 5B, chevrons 502C of FIG. 5C, or triangles 502D of FIG. 5D), a curved or curvilinear pattern (e.g., hexagonal-pack circles 502E of FIG. 5E), irregular patterns (e.g., irregular shapes 502F of FIG. 5F), a combination of patterns (e.g., hexagons and circles 502G of FIG. 5G), or the like. Cells 502 may define other patterns such as, for example, parallel trenches, square wells, fractal patterns, pedestals, or concentric circles.

The pattern of cells 502 may extend on textured surfaces 504 to provide mechanical adhesion between barrier layers 500 and any subsequent coating (e.g., overlying layer 16 of FIG. 1). In some examples, cells 502 may serve to redistribute in-plane stresses, such as thermal stress or mechanical stress resulting from operations of an article including barrier layers 500, including stress resulting from crystallization of TGO between barrier layers 500 and a coating. For example, stress exerted on barrier layers 500A in the y-axis direction of FIG. 5A, may be redistribute across the x-y plane as a result of the macroscopic pattern of plurality of cells 502A.

Figure 6:
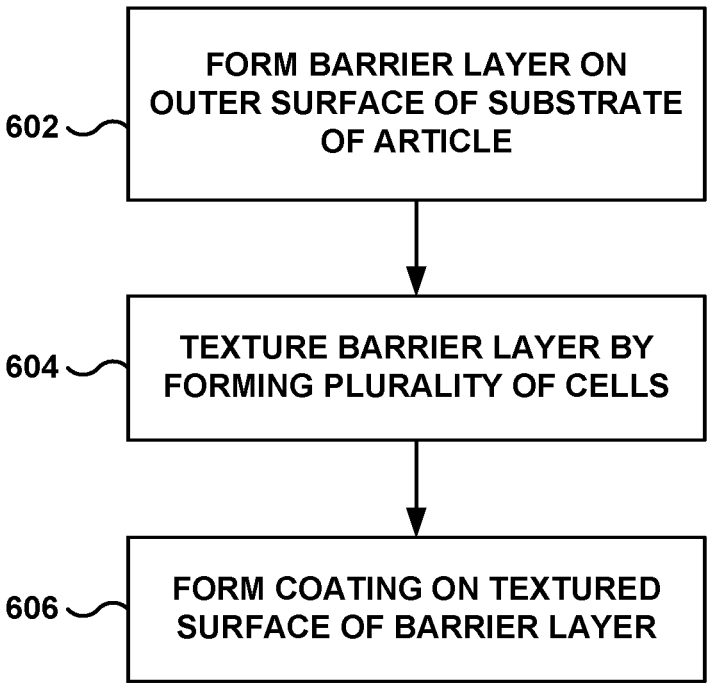
FIG. 6 is a flow diagram illustrating an example technique for forming an article that includes a barrier layer having a textured surface, and an overlying layer on the textured surface of the barrier layer.

The articles, coatings, and/or and cells described herein may be formed using any suitable technique. For example, FIG. 6 is a flow diagram illustrating example technique for forming an article that includes a substrate; a barrier layer formed on an outer surface of the substrate, the barrier layer defining a textured surface having a plurality of cells each having a geometry and a depth; a bond coat formed on the textured surface of the barrier layer; and a coating formed on the bond coat. While the technique of FIG. 6 is described with concurrent reference to the conceptual diagram of FIGS. 1-5G, in other examples, the technique of FIG. 6 may be used to form other articles, or articles illustrated in FIGS. 1-5G may be formed using a technique different than that described in FIG. 6.

The technique of FIG. 6 includes forming barrier layer 14 on outer surface 18 of substrate 12 of article 10 (602). As discussed above, forming barrier layer 14 may include chemical vapor deposition (CVD), such as CVD of SiC. In other examples, forming barrier layer 14 may include spraying (e.g., thermal spraying or plasma spraying), pressure vapor deposition (PVD), directed vapor deposition (DVD), dipping, electroplating, chemical vapor infiltration (CVI), or the like.

The technique illustrated in FIG. 6 also includes texturing barrier layer 14 by forming plurality of cells 22 in barrier layer 14 (604). As discussed above, each cell of cells 22 has a geometry and a depth, where the depth of a respective cell is different than the depth of each adjacent cell. Cells 22 may be formed using any suitable technique including, for example, laser ablation, non-ablation laser surface modification, focus ion beam ablation, plasma cutting, masking with plasma etching, micro-machining, or the like. In some examples, laser 400 may be directed at textured surface 20 of barrier layer 14 to remove portions of the material of barrier layer 14. In some examples, cells 22 may be formed to define a macrostructure pattern (as illustrated in FIGS. 5A-5G) progressing on textured surface 304 of bond coat 300.

In some examples, forming and texturing barrier layer 14 may include 3D printing barrier layer 14 or a portion of barrier layer 14 onto outer surface 18 of substrate 12. For example, a first portion of barrier layer 14 may be formed by spraying (e.g., thermal spraying or plasma spraying), pressure vapor deposition (PVD), chemical vapor deposition (CVD), directed vapor deposition (DVD), dipping, electroplating, chemical vapor infiltration (CVI), or the like, and a second portion of barrier layer 14 may be formed by 3D printing the second portion onto an outer surface of the first portion. As one example, the first portion of barrier layer 14 may include any portion of barrier layer 14 below textured surface 20, e.g., such that cells 22 do not extend into the first portion of barrier layer 14. The second portion of barrier layer 14 may include cells 22 defining textured surface 20. The term 3D printing may include any suitable additive manufacturing process, such as, for example, stereolithography, digital light processing, fused deposition modeling, selective laser sintering, selective melting, electronic beam melting, laminated object manufacturing, binder jetting, or material jetting. In some example, 3D printing may be used as alternative to, or in addition to, subtractive manufacturing processes, e.g., laser ablation or non-ablation laser surface modification. By using additive manufacturing processes, material loss during subsequent processing may be reduced.

The technique of FIG. 4 also includes forming an overlying layer 16 on textured surface 20 (606). In some examples, overlying layer 16 may include a plurality of layers, such as, for example, one or more second barrier layers, one or more bond coats, one or more EBC layers, one or more TBC layers, and/or one or more abradable layers. In some examples, the increase the interface area of the bonding surface established by the cell structure may improve the adhesion between overlying layer 16 and substrate 12. In some examples, the technique may include texturing one or more layers of overlying layer 16 prior to the application of subsequent layers.

Various examples have been described. These and other examples are within the scope of the following claims.

The invention claimed is:

1. An article comprising:

a substrate defining an outer surface, the substrate including boron;

a barrier layer on the outer surface of the substrate, wherein the barrier layer includes silicon carbide, wherein the barrier layer defines a textured surface having a plurality of cells, each cell having a geometry in a major plane of the barrier layer and a depth;

a bond coat on the textured surface of the barrier layer; and an environmental barrier coating (EBC) on a surface of the bond coat, the EBC having a porosity of less than about 20 volume percent, wherein the EBC defines a non-textured surface which defines an outer surface of the article, and wherein the barrier layer is configured to reduce overall migration of the boron into the bond coat to reduce formation of crystalline phase thermally grown oxide between the bond coat and the EBC.

2. The article of claim 1, wherein the surface of the bond coat comprises a second textured surface, and wherein the EBC is formed on the second textured surface of the bond coat.

3. The article of claim 1, wherein the substrate comprises a ceramic or a ceramic matrix composite.

4. The article of claim 1, wherein the article comprises a component of a high temperature mechanical system, wherein the geometry of a respective cell of the plurality of cells is based on a predicted stress at the respective cell during operation of the high temperature mechanical system.

5. The article of claim 1, wherein the geometry comprises a width of a respective cell of the plurality of cells, wherein the width is within a range from about 5 microns to about 250 microns, and wherein the depth of each cell is within a range from about 1 micron to about 75 microns.

6. The article of claim 1, wherein the textured surface of the barrier layer comprises a surface roughness (Ra) within a range from about 3 microns to about 75 microns.

7. The article of claim 1, wherein the barrier layer defines a thickness within a range from about 5 microns to about 100 microns.

8. The article of claim 1, wherein the depth of a respective cell is different than the depth of at least one adjacent cell.

9. The article of claim 1, wherein a density of the barrier reduces the migration of the boron from the substrate into the bond coat.

10. The article of claim 1, wherein the barrier layer is a continuous layer over the outer surface of the substrate.

11. A gas turbine engine component, comprising:

a ceramic composite matrix (CMC) substrate defining an outer surface, the substrate including boron;

a silicon carbide barrier layer on the outer surface of the substrate, wherein the barrier layer defines a textured surface having a plurality of cells, each cell having a geometry in a major plane of the barrier layer and a depth;

a bond coat formed on the textured surface of the barrier layer; and an environmental barrier coating (EBC) formed on the bond coat, the EBC having a porosity of less than about 20 volume percent, and wherein the barrier layer is configured to reduce migration of the boron from the CMC substrate into the bond coat to reduce formation of crystalline phase thermally grown oxide between the bond coat and the EBC.

12. The gas turbine engine component of claim 11, wherein the bond coat defines a second textured surface having a second plurality of cells, and wherein the EBC is formed on the second textured surface of the bond coat.

13. A method for forming an article, the method comprising:

forming a barrier layer on an outer surface of a substrate;

texturing a surface of the barrier layer to form a textured surface by forming a plurality of cells in the barrier layer, each cell having a geometry in a plane of the barrier layer and a depth;

subsequently forming a bond coat on the textured surface of the barrier layer; and forming an environmental barrier coating (EBC) on a surface of the bond coat, the EBC having a porosity of less than about 20 volume percent, wherein the EBC defines a non-textured surface which defines an outer surface of the article, and wherein the barrier layer is configured to reduce overall migration of the boron into the bond coat to reduce formation of crystalline phase thermally grown oxide between the bond coat and the EBC.

14. The method of claim 13, wherein forming the bond coat further comprises texturing the surface of the bond coat to form a second textured surface, and wherein forming the EBC comprises forming the EBC on the second textured surface of the bond coat.

15. The method of claim 13, wherein the substrate comprises a ceramic or a ceramic matrix composite, and wherein forming the barrier layer comprises forming, by chemical vapor deposition, a silicon carbide barrier layer on the outer surface of the substrate.

16. The method of claim 13, wherein the article comprises a component of a high temperature mechanical system, wherein texturing the barrier layer comprises forming the plurality of cells based on a predicted stress at each respective cell of the plurality of cells during operation of the high temperature mechanical system.

17. The method of claim 13, wherein texturing the surface of the barrier layer comprises removing, by laser ablation or non-ablation laser surface modification, at least a portion of barrier layer to form the plurality of cells.

18. The method of claim 13, wherein forming the barrier layer comprises forming, by chemical vapor deposition, a silicon carbide barrier layer, and wherein the method further comprises thermal spraying a second silicon carbide barrier layer on the textured surface of the barrier layer.

19. The method of claim 13, wherein the barrier layer defines a thickness within a range from about 5 microns to about 100 microns.

20. The method of claim 13, wherein the depth of a respective cell is different than the depth of at least one adjacent cell.

* * * * *